United States Patent [19]

Sollinger

[11] Patent Number: 4,903,632

[45] Date of Patent: Feb. 27, 1990

[54] COATING DEVICE

[75] Inventor: Hans-Peter Sollinger, Heidenheim, Fed. Rep. of Germany

[73] Assignee: J. M. Voith, GmbH, Heidenheim, Fed. Rep. of Germany

[21] Appl. No.: 281,891

[22] Filed: Dec. 5, 1988

[30] Foreign Application Priority Data

May 16, 1986 [DE] Fed. Rep. of Germany ..... 3616645

[51] Int. Cl.[4] ..... B05C 1/04; B05C 1/16

[52] U.S. Cl. ..... 118/123; 118/126; 118/410; 118/419

[58] Field of Search ..... 118/410, 407, 413, 419, 118/123, 56, 126

[56] References Cited

U.S. PATENT DOCUMENTS

| | | | |
|---|---|---|---|
| 3,150,997 | 12/1964 | Pelletier et al. | 118/407 |
| 3,179,536 | 4/1965 | Martinek | 118/407 X |
| 4,250,211 | 2/1981 | Damrau et al. | 118/411 X |
| 4,369,731 | 1/1983 | Damrau | 118/413 X |
| 4,405,661 | 9/1983 | Alheid | 118/420 X |
| 4,495,888 | 1/1985 | Wohrle et al. | 118/410 |
| 4,643,127 | 2/1987 | Wanke | 118/413 |

FOREIGN PATENT DOCUMENTS

| | | | |
|---|---|---|---|
| 3446525 | 1/1985 | Fed. Rep. of Germany | 118/413 |
| 3438380 | 4/1986 | Fed. Rep. of Germany | 118/410 |
| 2158371 | 11/1985 | United Kingdom | 118/413 |

OTHER PUBLICATIONS

Eck, Technische Strömungslehre, pp. 3 & 3.5, Springer-Verlag, Berlin (not dated) and Translation.

*Primary Examiner*—Willard Hoag

*Attorney, Agent, or Firm*—Albert L. Jeffers; Richard L. Robinson

[57] ABSTRACT

A coating device for coating moving material webs running over a backing roll has a front wall, coating element, and side seals cooperating to provide a sealed application space for the material web near the backing roll, which application space is preferably at a pressure above atmospheric pressure and has a coating mixture flowing therein from a chamber. A baffle connected to the front wall provides a run-out gap therebetween and cooperates with the backing roll to provide a hydrodynamic pressure gap at the material web run-in side, such that coating mixture from run-out gap is entrained by the speed of the material web for reintroduction to application space through hydrodynamic pressure gap.

20 Claims, 1 Drawing Sheet

COATING DEVICE

This is a continuation of application Ser. No. 046,129, filed May 4, 1987, abandoned.

The invention concerns a coating device for coating moving material webs running over a backing roll. Such a device is shown in U.S. Pat. No. 4,250,211.

This coating device has an application space adjacent to a coating element, which preferably is a doctor blade sealed on all sides. The coating mixture with a large surplus is fed to the application space from a generally pressurized feed chamber and is spread by the doctor blade. Surplus mixture in the application space is discharged opposite to the direction of travel of the web through a choking gap between the backing roll and a plate. This application technique is necessary to improve the coating conditions for generating a coating which is as smooth and uniform as possible. Present coating devices may not smoothly and uniformly coat the web with both lightly and heavily applied coating weights.

SUMMARY OF THE INVENTION

The present invention is an improved coating device which provides a uniform coating for both light and heavy coating weights. The coating weight uniformity problem in coating devices increases at light coating weights.

The improved coating device overcomes the coating weight variation problem by providing a baffle arrangement in the area of a front wall, which baffle is essentially parallel to the axis of the backing roll. The baffle and backing roll provide a hydrodynamic pressure gap; and, the baffle and front wall provide a feed channel for the coating mixture from the application space for the hydrodynamic pressure gap.

An alternative embodiment provides an arc-shaped deflector at the front wall to direct the coating mixture to the backing roll. An outlet gap can be provided to channel the excess flow of surplus coating mixture not entrained with the flow at the backing wall.

BRIEF DESCRIPTION OF THE DRAWING

In the Figures of the Drawing, like reference numerals identify like components, and in the Drawing.

DETAILED DESCRIPTION OF THE INVENTION

Figure 1:
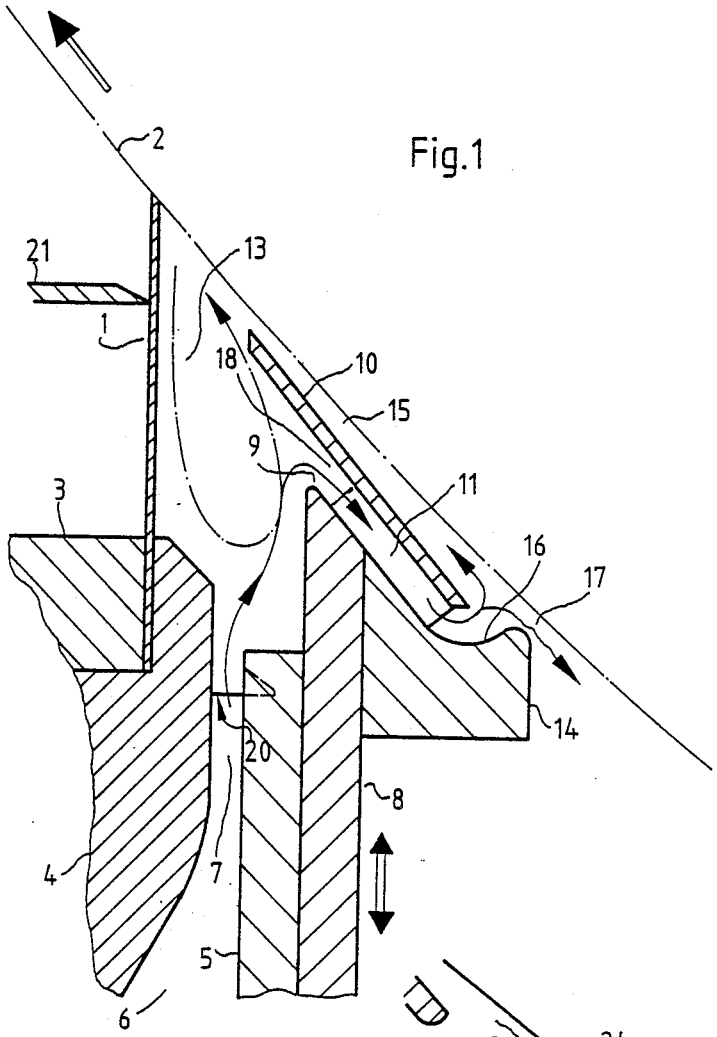
FIG. 1 is a cross-sectional view of the coating device.

The invention will be explained with the aid of the embodiments illustrated schematically in FIGS. 1 and 2 of the Drawing, which essentially represent a cross-section through the coating device. The cross-hatched components extend parallel to the axis of the backing roll, essentially across its width or the greatest width of the web to be processed, that is, the paper web.

The coating doctoring element, doctor blade 1, in FIG. 1 is retained in a mounting between a clamping beam 3 on support beam 4 and an extending part of beam 4. The doctor blade 1 is forced on backing roll 2, which supports the web, either by moving the entire illustrated device or by pressure component 21, which is illustrated by dash-dot lines. Doctor blade 1 and front wall 8 define an application space 13 for the coating mixture exclusive of the space occupied by the baffle and the hydrodynamic pressure gap, which is generally at a pressure above atmospheric pressure. Application space 13 is sideways sealed by sealing components, which are indicated as element 20 and are fixed in the coating device by means of dovetailing. The coating mixture flows into application space 13 from a pressurized feed chamber or coating chamber 6 with a front wall support 5. The front wall 8 of the application space 13 is retained and movable on front wall support 5 as indicated by the double arrow. A discharge gap or primary feed channel 7 from the feed chamber or coating chamber 6 is preferably provided so that the coating mixture will flow as evenly as possible into the application space 13 with a large surplus that will first flow out of the application chamber 13 over edge 9 of front wall 8. The coating mixture flows into a gap 18 formed by a baffle 10, such as a sheet metal baffle, and front wall 8 or an extension 14 of front wall 8. The baffle 10 is supported by ribs 11 connected to front wall 8.

Baffle 10, is essentially parallel with the axis of backing roll 2; and, in the direction of web travel, baffle 10 and roll 2 form a small acute angle tq define a hydrodynamic pressure gap 15. Extension 14 is shown with an arc-shaped wall 16 which deflects the discharging coating mixture surplus toward backing roll 2. Part of the surplus is entrained by the speed of the web into the hydrodynamic pressure gap 15 at the material web entrance. A liquid pressure forms and the coating mixture is increasingly forced into the material web, preferably a paper web. Thus a prepenetration of the web by the coating mixture, occurs so that subsequently a very smooth coating can be applied, as the coating mixture remaining at the web surface no longer retroactively penetrates the web.

The front edge of extension 14, which is the entrance side of the hydrodynamic pressure gap, forms a discharge gap 17 for the surplus coating mixture. Gap 17 is necessary for providing reasonably manageable flow conditions in application space 13. In addition, gap 17 prevents entrainment of larger amounts of air.

Figure 2:
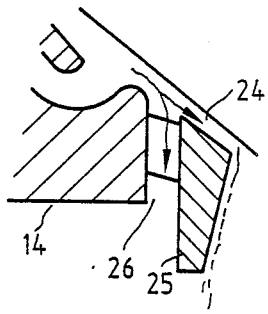
FIG. 2 is a cross-sectional end view of an alternative embodiment of the entrance area of the extension.

As shown in FIG. 2, the entrance area of extension 14 can be supplemented by another choking gap 24 formed between choking component 25 and backing roll 2, which arrangement provides particularly smooth run-in conditions. The pressure of the discharging coating mixture is reduced so that only a film of coating mixture will move outward along choking component 25 through choking gap 24, while the majority of the surplus coating mixture drains through a gap 26 formed between extension 14 and choking component 25.

The invention has been described in connection with specific embodiments thereof, it is understood that this is by way of illustation and not by way of limitation. The scope of thet appended claims should be construed as broadly as the prior art permits.

What is claimed is:

1. A coating device for coating moving material webs running over a backing roll with an axis, and having an entrance side, an exit side and connected to a pressurized coating chamber, said coating device comprising:

a pressurized coating chamber;

a doctor blade at said exit side;

an entrance side front wall movably mounted relative a front wall support cooperating with said backing roll to define a discharge gap;

sideways sealing elements cooperating with said doctor blade and entrance side front wall defining and sealing an application space except for said discharge gap;

a primary feed channel communicating between said pressurized coating chamber and said application space for transferring coating mixture therebetween; and an elongate baffle parallel to the backing roll axis and disposed at a small acute angle with respect to the backing roll in proximity to said entrance side front wall, said baffle having an elongate backing roll side and an elongate front wall side opposite said backing roll side;

said baffle backing roll side cooperating with said backing roll to define an elongate hydrodynamic pressure gap therebetween having a length substantially equal to that of the elongate backing roll side of said baffle;

said baffle front wall side cooperating with said front wall to define a secondary gap-shaped feed channel for communication of a surplus of the coating mixture between said application space and said hydrodynamic pressure gap, said hydrodynamic pressure gap comprising a return entrance to said application space for said coating mixture.

2. A coating device as claimed in claim 1 wherein said baffle has the shape of a doctor blade.

3. A coating device as claimed in claim 1 wherein said coating chamber includes a coating chamber front wall support;

said doctor blade defines a plane; and, said entrance side front wall defining said application space is adjustable in a plane essentially parallel to said doctor blade plane.

4. A coating device as claimed in claim 1 wherein said hydrodynamic gap has an outlet end and a gap width, which outlet end is the narrowest point of said hydrodynamic gap, said gap width at said narrowest point being less than 4 millimeters.

5. A coating device as claimed in claim 4 wherein said baffle has the shape of a doctor blade.

6. A coating device as claimed in claim 4 wherein said coating chamber includes a coating chamber front wall support;

said doctor blade defines a plane; and, said entrance side front wall defining said application space is movably mounted on said coating chamber front wall support and adjustable in a plane essentially parallel to said doctor blade plane.

7. A coating device as claimed in claim 1 wherein said hydrodynamic pressure gap has an entrance side adjacent said discharge gap; and an extension is mounted on said front wall, which extension has an arc-shaped wall section extending toward said backing roll at said hydrodynamic pressure gap entrance side;

whereby said arc-shaped wall section deflects said surplus mixture toward said backing roll.

8. A coating device as claimed in claim 7 further comprising a choking component mounted on said extension, said choking component cooperating with the backing roll to define a choking gap; and said choking component further cooperating with said extension to define a drain gap therebetween for discharging said surplus coating mixture.

9. A coating device as claimed in claim 7 wherein said baffle has the shape of a doctor blade.

10. A coating device as claimed in claim 7 wherein said hydrodynamic gap has an outlet end and a gap width, which outlet end is the narrowest point of said hydrodynamic gap, said gap width at said narrowest point being less than 4 millimeters.

11. A coating device as claimed in claim 10 further comprising a choking component mounted on said extension, said choking component cooperating with the backing roll to define a choking gap; and said choking component further cooperating with said extension to define a drain gap therebetween for discharging said surplus coating mixture.

12. A coating device as claimed in claim 7 wherein said coating chamber includes a coating chamber front wall support;

said doctor blade defines a plane; and, said entrance side front wall defining said application space is adjustable in a plane essentially parallel to said doctor blade plane.

13. A coating device as claimed in claim 12 further comprising a choking component mounted on said extension, said choking component cooperating with the backing roll to define a choking gap; and said choking component further cooperating with said extension to define a drain gap therebetween for discharging said surplus coating mixture.

14. A coating device as claimed in claim 7 wherein said extension cooperates with said backing roll upstream of said baffle to define said outlet gap.

15. A coating device as claimed in claim 14 wherein said baffle has the shape of a doctor blade.

16. A coating device as claimed in claim 14 further comprising a choking component mounted on said extension, said choking component cooperating with the backing roll to define a choking gap; and said choking component further cooperating with said extension to define a drain gap therebetween for discharging said surplus coating mixture.

17. A coating device as claimed in claim 14 wherein said hydrodynamic gap has an outlet end and a gap width, which outlet end is the narrowest point of said hydrodynamic gap, said gap width at said narrowest point being less than 4 millimeters.

18. A coating device as claimed in claim 17 further comprising a choking component mounted on said extension, said choking component cooperating with the backing roll to define a choking gap; and said choking component further cooperating with said extension to define a drain gap therebetween for discharging said surplus coating mixture.

19. A coating device as claimed in claim 14 wherein said coating chamber includes a coating chamber front wall support;

said doctor blade defines a plane; and, said entrance side front wall defining said application space is movably mounted on said coating chamber front wall support and adjustable in a plane essentially parallel to said doctor blade plane.

20. A coating device as claimed in claim 19 further comprising a choking component mounted on said extension, said choking component cooperating with the backing roll to define a choking gap; and said choking component further cooperating with said extension to define a drain gap therebetween for discharging said surplus coating mixture.

* * * * *